US012631433B1

(12) United States Patent
Cleveland et al.

(10) Patent No.: US 12,631,433 B1
(45) Date of Patent: May 19, 2026

(54) ROTATIONAL ALIGNMENT SYSTEM

(71) Applicant: BAE Systems Information and Electronic Systems Integration Inc., Nashua, NH (US)

(72) Inventors: Kenneth D. Cleveland, Hollis, NH (US); Sean Smith, Medford, MA (US); Jared B. Foster, Jamaica Plain, MA (US); Emile A. Desrochers, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 19/048,401

(22) Filed: Feb. 7, 2025

(51) Int. Cl.
*F42B 15/36* (2006.01)
*F42B 15/01* (2006.01)

(52) U.S. Cl.
CPC ..... *F42B 15/36* (2013.01); *F42B 15/01* (2013.01)

(58) Field of Classification Search
CPC .... F16B 19/02; F16B 23/0092; F16B 33/004; F16B 5/025; F16B 35/045; F16B 5/0642; F42B 15/36; F42B 15/01
USPC ..... 102/377, 372; 244/3.24, 3.28, 3.29, 3.3; 89/1.1
See application file for complete search history.

(56) References Cited

U.S. PATENT DOCUMENTS

| | | | |
|---|---|---|---|
| 4,899,956 | A | 2/1990 | King et al. |
| 6,398,156 | B2 | 6/2002 | Hetzer et al. |
| 8,156,867 | B2 | 4/2012 | Stimpson |
| 8,934,776 | B2 | 1/2015 | Steenson, Jr. et al. |
| 10,690,160 | B2 | 6/2020 | Chan et al. |
| 10,711,815 | B2 | 7/2020 | Chan et al. |
| 10,852,116 | B2 | 12/2020 | Feda |
| 11,067,372 | B2 | 7/2021 | Schorr et al. |
| 11,287,233 | B2 | 3/2022 | Zemany et al. |
| 11,561,077 | B2 | 1/2023 | Feda et al. |
| 11,879,503 | B2 | 1/2024 | Scott et al. |
| 11,981,460 | B2 | 5/2024 | Muceus et al. |
| 12,253,341 | B1 | 3/2025 | Minguy |
| 12,540,794 | B2 | 2/2026 | Miska et al. |
| 2010/0301536 | A1* | 12/2010 | Wilson ..... B25B 27/16 269/53 |
| 2012/0060672 | A1 | 3/2012 | Grigg |

(Continued)

FOREIGN PATENT DOCUMENTS

| | | | |
|---|---|---|---|
| EP | 2438389 | B1 | 5/2017 |

*Primary Examiner* — Michael D David
(74) *Attorney, Agent, or Firm* — Scott J. Asmus

(57) ABSTRACT

Techniques are provided for rotational alignment of platform sections. An aeronautical platform implementing the techniques according to an embodiment includes a first section; a second section comprising a threaded interface; and a threaded retainer disposed around an end of the first section, that is be coupled to the second section. The threaded retainer is configured to rotate about a longitudinal axis of the first section while rotationally advancing into the threaded interface of the second section. The platform also includes a plurality of alignment pins disposed on the end of the first section and a plurality of alignment holes disposed on the second section. Each of the alignment pins is configured to engage with a corresponding one of the alignment holes to maintain alignment of the first section to the second section as the threaded retainer rotationally advances into the threaded interface.

20 Claims, 7 Drawing Sheets

(56) References Cited

U.S. PATENT DOCUMENTS

| | | | | |
|---|---|---|---|---|
| 2016/0325853 | A1* | 11/2016 | Stone | B64F 5/40 |
| 2022/0111956 | A1* | 4/2022 | Jordan | B64C 27/473 |
| 2022/0153452 | A1* | 5/2022 | Smith | B64F 5/50 |
| 2025/0136297 | A1 | 5/2025 | Miska | |

* cited by examiner

ROTATIONAL ALIGNMENT SYSTEM

STATEMENT OF GOVERNMENT INTEREST

This invention was made with United States Government assistance under Contract No. FA865124FB042. The United States Government has certain rights in this invention.

FIELD OF DISCLOSURE

The present disclosure relates to rotational alignment systems, and more particularly to coupling of sections of a cylindrical-shaped aeronautical platform while maintaining a desired rotational alignment.

BACKGROUND

Many aeronautical platforms, such as missiles, are made up of multiple sections that need to be joined together during final assembly. In some cases, one or more of the sections may need to be aligned relative to each other at a specific angular orientation. This can present challenges during the manufacturing assembly process.

Figure 1:
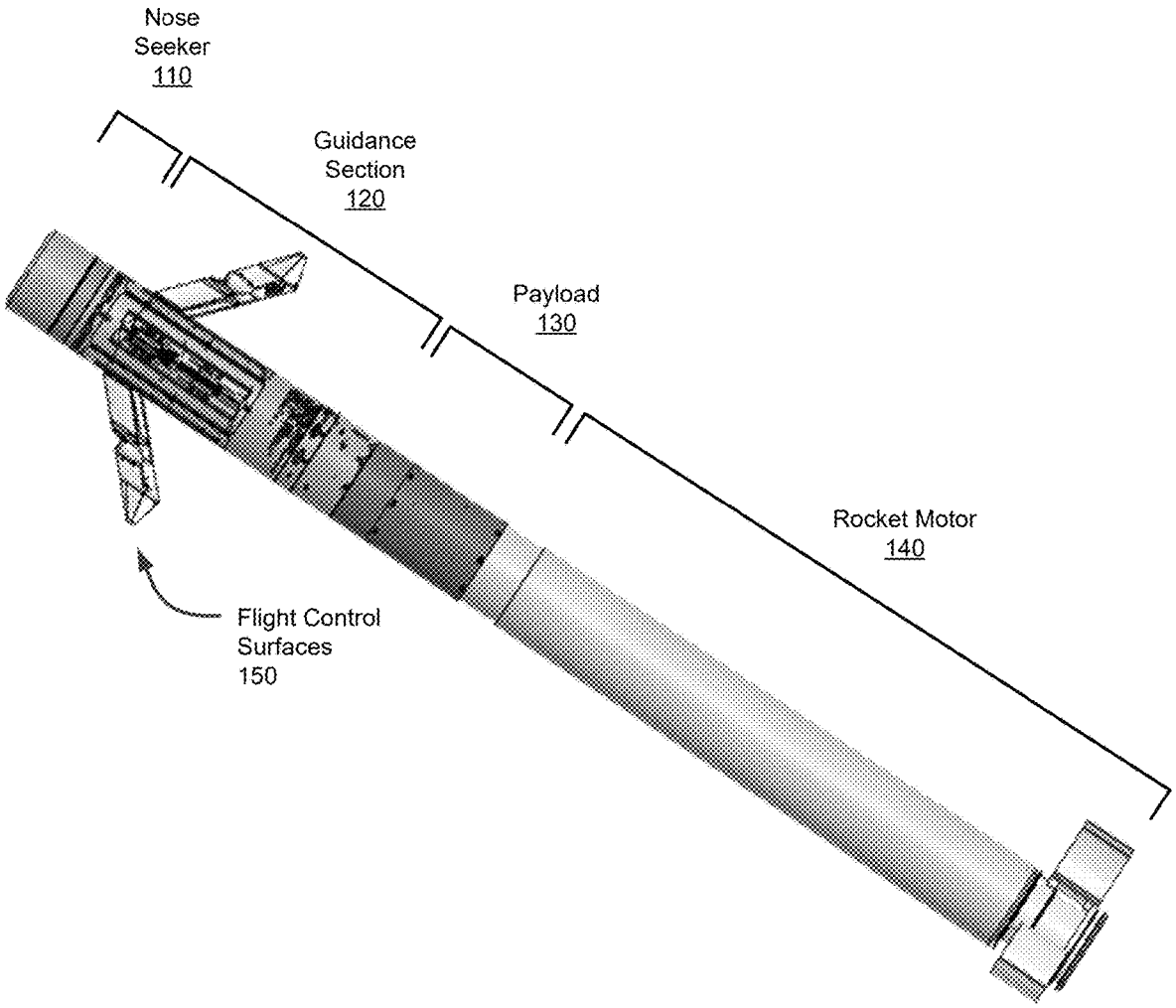
FIG. 1 illustrates sections of an aeronautical platform, configured in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

Techniques are provided herein for a rotational alignment system to facilitate the coupling of sections of a cylindrical platform, such as a missile or other cylindrical aeronautical platform, that need to be aligned at a specific angular orientation relative to each other after final assembly. As noted above, this requirement can present challenges during the manufacturing assembly process. For example, if one section is joined to another section by screwing the sections together, the screw threading on both sections must be designed in a manner such that the screw bottoms out at a depth that results in a correct final angular orientation of the sections. This can be difficult, expensive, and time consuming. Furthermore, that method may be specific to a particular pair of sections and not generalizable to allow mixing and matching of other component sections, such as various sections that which may be attendant to an all-up-round missile. Other techniques rely on post-coupling calibration of the component sections to account for angular orientation mismatch. This approach is also time consuming, expensive, and not always feasible since it requires unique calibration for each pair of sections, thereby reducing interchangeability. Still other techniques employ shims between sections that are threaded together to change the axial distance between the sections and therefore the rotational alignment. This approach requires customizing the shim thickness for each unique pair of sections, which is time consuming and requires trial and error to achieve the desired result.

To this end, and in accordance with an embodiment of the present disclosure, a rotational alignment system is provided which allows a first section of the platform to be screwed into the second section of the platform without requiring the first section to rotate during the coupling process. Thus, the first and second sections can maintain any desired angular orientation relative to one another during the coupling process. After the coupling is completed, the two sections will be aligned in the desired orientation.

In accordance with an embodiment, an aeronautical platform implementing the techniques for rotational alignment according to an embodiment includes a first section and a second section that is be coupled to the first section. The first section includes a captive threaded retainer disposed around one end of the first section. The second section includes a threaded interface configured to receive the threaded retainer. The threaded retainer is configured to rotate about a longitudinal axis of the first section while rotationally advancing into the threaded interface of the second section. The platform also includes a plurality of alignment pins disposed on the end of the first section and a plurality of alignment holes and/or slots disposed on the second section. Each of the alignment pins is configured to engage with a corresponding one of the alignment holes/slots to maintain alignment of the first section to the second section as the threaded retainer rotationally advances into the threaded interface.

Although the techniques described herein are directed to an aeronautical platform such as a missile, it will be appreciated that the disclosed techniques may be applied to the coupling of sections or components of any cylindrical platform for which rotational alignment is required.

It will be appreciated that the techniques described herein may provide for an improved fabrication/manufacturing process for multi-section platforms that require rotational alignment between sections, compared to other methods that require specially fabricated and costly threads or time consuming calibration procedures or shims. Numerous embodiments and applications will be apparent in light of this disclosure.

System Architecture

FIG. 1 illustrates sections of an aeronautical platform 100, configured in accordance with certain embodiments of the present disclosure. The aeronautical platform 100 can be a guided missile, guided rocket, or a guided bomb. In this example, the aeronautical platform 100 is a missile comprising four stages: a nose seeker 110, a guidance section 120, a payload 130, and a rocket motor 140. Such a completed configuration may also be referred to as an all-up-round missile. In other examples, only some of the stages are included (e.g., nose seeker 110 and guidance section 120), so as to provide a partial assembly that may be completed at a later time (e.g., where payload 130 and rocket motor 140 are added). In further examples certain sections can be combined and integrated. Generally, each of the stages has a cylindrical or tubular cross-section, not counting the flight control surfaces of the guidance section and rocket motor. As shown, the various stages can be coupled together so as to provide an aeronautical platform or housing having a cylindrical profile to facilitate flight, and further allow various componentry (e.g., electronics and payload materials) to be configured within one or more voids within the platform.

The nose seeker 110 in this example comprises sensors (e.g., thermal imaging, radar, etc.) and associated electronics that are configured to identify and detect targets of interest to which the missile 100 should be guided. This directional targeting information is communicated to the guidance section 120.

The guidance section 120 is configured to guide the missile 100. In some embodiments, targeting information may be provided to the guidance section by the nose seeker 110. In some embodiments, targeting information may be provided by sensors within the guidance section. Such sensors in one example are mounted on the flight control surfaces 150. A modular approach to coupling of sections allows for multiple configurations for a specific mission while still achieving alignment. In some embodiments, the guidance section 120 is configured to guide the missile 100 by manipulating flight control surfaces 150. Because the nose seeker 110 and the guidance section 120 operate on directions in some suitable coordinate system, they need to have a common frame of reference (e.g., an "up" direction for the nose seeker should be the same as an "up" direction for the guidance section). In some embodiments, this common frame of reference is achieved through rotational alignment of the two sections to a particular angular orientation.

The payload 130 is configured to store a payload for the missile 100. In some embodiments, for example, this may be a warhead and comprise explosives.

The rocket motor 140 is configured to provide thrust to the missile 100 to accelerate the missile and maintain a suitable velocity to a chosen destination, for example the destination determined by the nose seeker 110. In some cases, the rocket motor expends its accelerant during the flight path to a target and the missile guides to the target.

Figure 2:
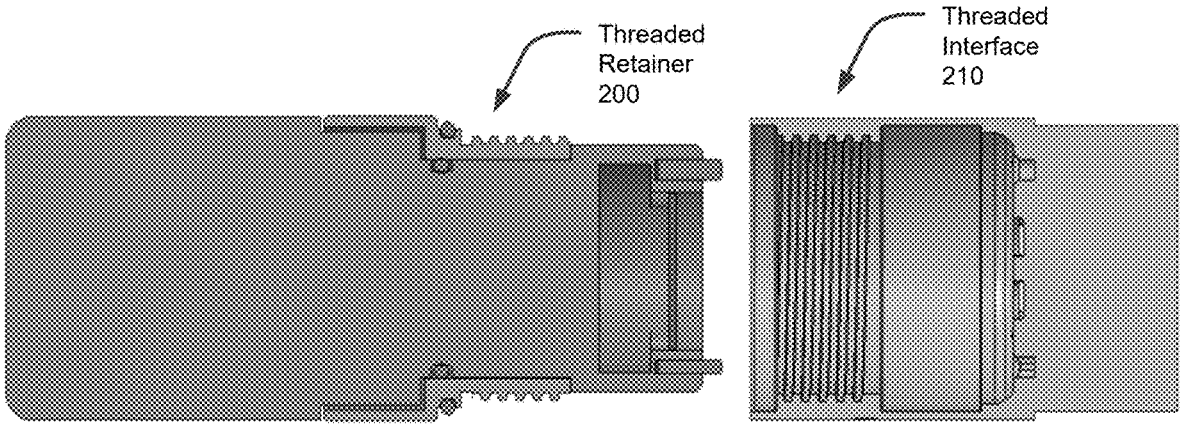
FIG. 2 illustrates the nose seeker and guidance section of the aeronautical platform of FIG. 1, configured in accordance with certain embodiments of the present disclosure.

FIG. 2 illustrates the nose seeker 110 and guidance section 120 of the aeronautical platform of FIG. 1, configured in accordance with certain embodiments of the present disclosure. In this Figure, the nose seeker 110 is shown prior to coupling/attachment to the guidance section 120. This example includes only the front end of the guidance section 120 (e.g., the end that couples to the nose seeker 110). Other examples may include further componentry of the guidance section 120. The nose seeker 110 and guidance section 120 are shown in cross-sectional views. The threaded retainer 200 of the nose seeker is configured to screw into the threaded interface 210 of the guidance section. The threaded retainer 200, however, is also configured to freely rotate about the nose section such that the nose section is allowed to remain in a fixed orientation as it is being drawn into the guidance section, as will be explained in greater detail below. The threaded retainer 200 is captive to the seeker nose 110 which means that, although it is free to rotate, it does not move laterally along a longitudinal axis of the nose seeker.

Figure 3A:
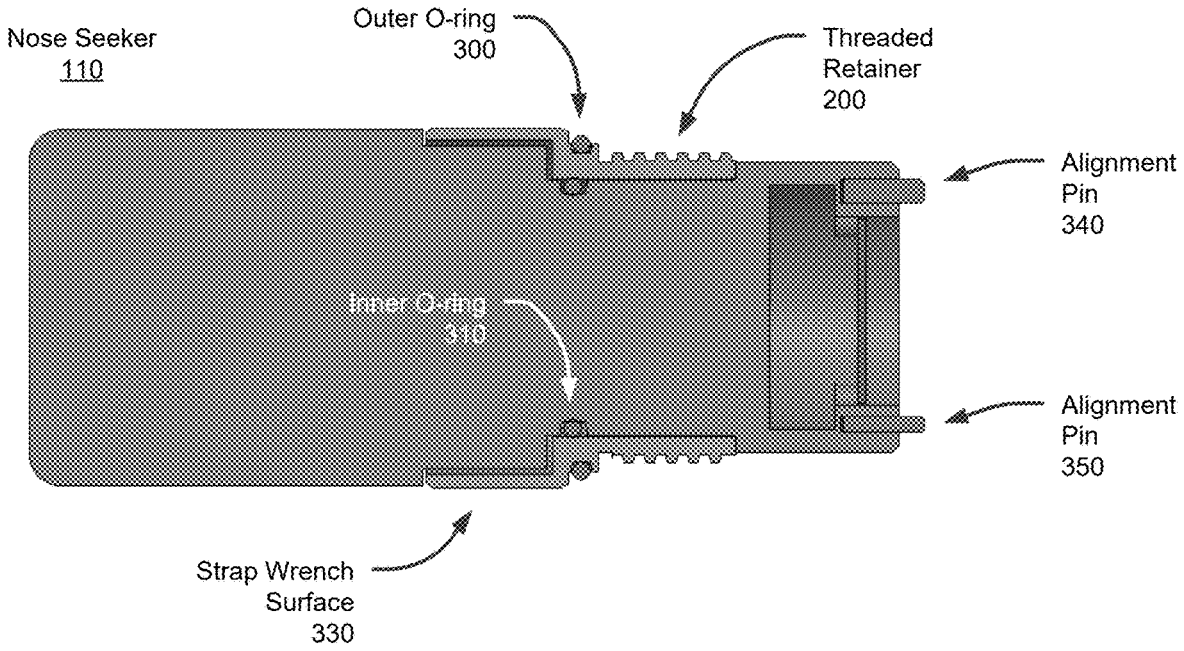
FIG. 3A provides a cross-section view of the nose seeker of FIG. 2, configured in accordance with certain embodiments of the present disclosure.

FIG. 3A provides a cross-section view of the nose seeker 110 of FIG. 2, configured in accordance with certain embodiments of the present disclosure. As seen in the cross-section view, the nose seeker 110 includes an outer O-ring 300, an inner O-ring 310, the threaded retainer 200, a strap wrench surface 330 (as part of the threaded retainer 200), a first alignment pin 340 and a second alignment pin 350.

The threaded retainer 200 is coupled to one end of the nose seeker (e.g., the end that is to be received by the guidance section). The threaded retainer 200 is a freely rotating captive threaded retainer that engages threads of the guidance section and clamps the nose seeker aft surface to the inside surface of the forward housing of the guidance section. Said differently, the threaded retainer 200 is coupled to the nose seeker in a manner that allows the threaded retainer to rotate freely about the nose seeker but remain fixed with respect to lateral movement along the longitudinal axis of the nose seeker.

The strap wrench surface 330 is a portion of the threaded retainer 200 that extends to the outer surface of the nose seeker and provides a flanged contact surface or engagement surface to which a tool (e.g., a strap wrench) can be applied to rotate and tighten the threaded retainer.

Outer O-ring 300 is configured to provide an environmental seal between the threaded retainer of the nose seeker and the guidance section after attachment of the two sections. Inner O-ring 310 is configured to provide an environmental seal between the threaded retainer and the interior of the nose section.

Alignment pins 340 and 350, which will be described in greater detail below, are configured to mate with alignment hole 410 and slot 420 of the guidance section to ensure that proper alignment is achieved and maintained.

Figure 3B:
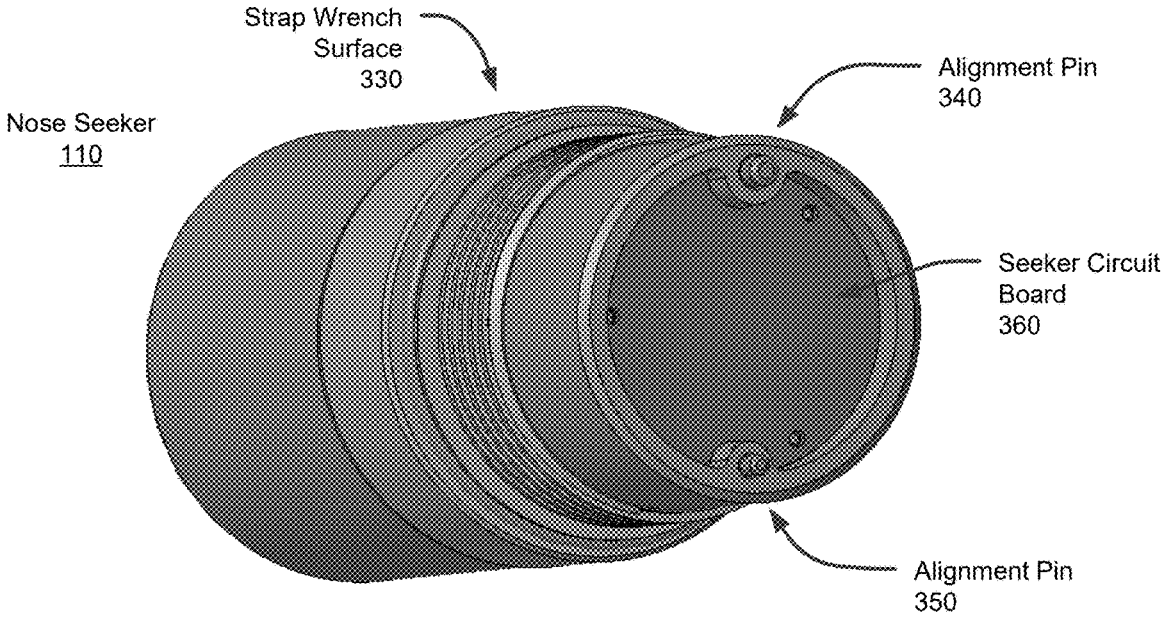
FIG. 3B provides a perspective view of the nose seeker of FIG. 2, configured in accordance with certain embodiments of the present disclosure.

FIG. 3B provides a perspective view of the nose seeker 110 of FIG. 2, configured in accordance with certain embodiments of the present disclosure. This view shows that, in some embodiments, a circuit board 360 may be located at the end of the nose seeker that is to be received by the guidance section. The circuit board may comprise electronics to control sensors within the nose seeker and to interface with circuitry in the guidance section. In some examples, the interface between electronics of the two sections may use electrical signal pins that align when the sections are aligned. In some examples, the interface may employ optical communication techniques in which the transmitters and receivers align when the sections are aligned.

Figure 4A:
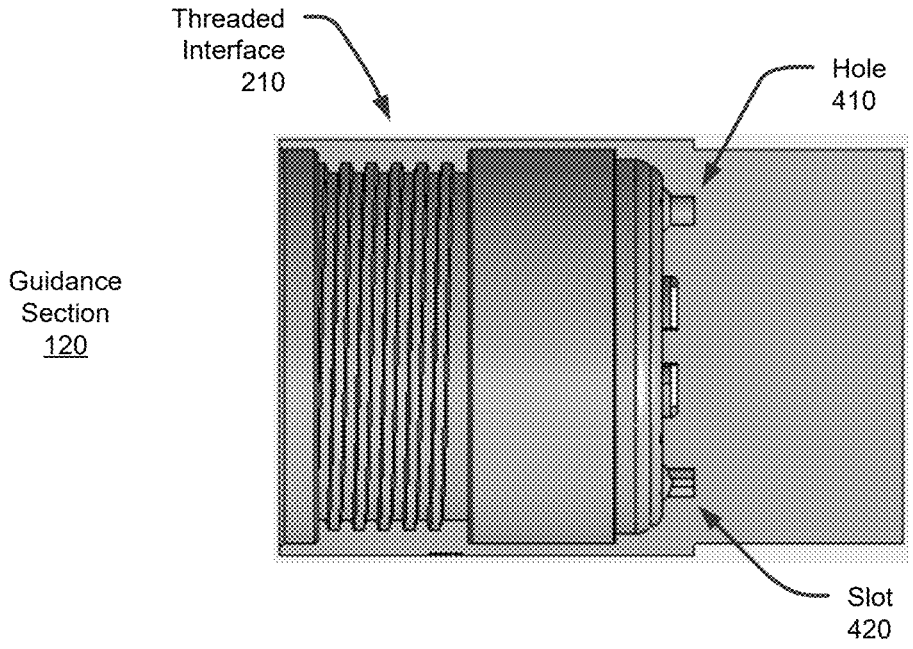
FIG. 4A provides a side view of the guidance section of FIG. 2, configured in accordance with certain embodiments of the present disclosure.

FIG. 4A provides a side view of the guidance section 120 of FIG. 2, configured in accordance with certain embodiments of the present disclosure. As seen in the side view, the guidance section 120 includes a threaded interface 210, hole 410 and slot 420. Because this is a side view, only the outer surface of the threaded interface 210 is visible. The threaded interface 210 is configured to receive the threaded retainer 200 of the nose seeker. As the threaded retainer is rotated into the threaded interface, the nose seeker is drawn into the guidance section while remaining in a fixed orientation relative to the guidance section (e.g., only the threaded retainer rotates).

Hole 410 and slot 420 are configured to receive the alignment pins 340 and 350, respectively, to ensure that the nose seeker has been held at the correct orientation as it is drawn into the guidance section and to lock the nose seeker into that fixed orientation after the threaded retainer has been completely screwed into the threaded interface. The alignment pins prevent relative rotation between the nose seeker and guidance section, due to inertial torque loads during launch and flight, by isolating the torque from the threaded retainer.

The alignment pins are keyed to the alignment hole and slot to ensure that each alignment pin is received into the correct alignment hole or slot. For example, as shown in these figures, alignment pin 340 and associated alignment hole 410 are larger than alignment pin 350 and associated alignment slot 420. Additionally, alignment pin 340 and associated alignment hole 410 are cylindrical while alignment pin 350 is configured to fit into associated alignment slot 420 which is an elongated cylindrical shape. Other configurations are possible including a diamond-shaped pin configured to fit into a cylindrical hole. In some embodiments, alignment hole 410 may also be a slot. In some embodiments, the pins, hole, and slot may be chamfered to facilitate guidance of the pins into the holes during assembly.

Figure 4B:
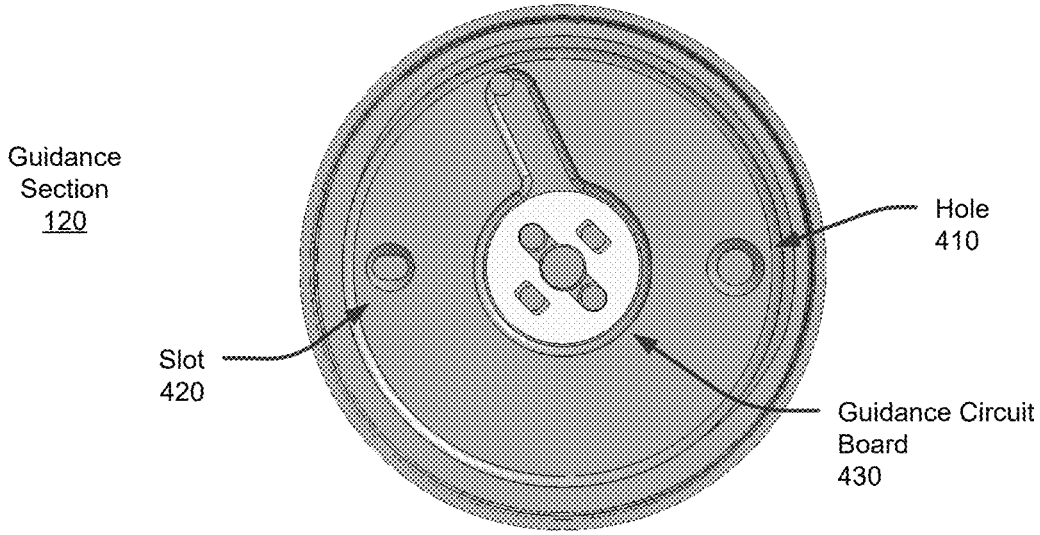
FIG. 4B provides an interior end view of the guidance section of FIG. 2, configured in accordance with certain embodiments of the present disclosure.

FIG. 4B provides an interior end view of the guidance section 120 of FIG. 2, configured in accordance with certain embodiments of the present disclosure. The perspective of this figure is looking into the interior of the guidance section from the point of view of the nose seeker. The alignment hole 410 and alignment slot 420 are visible. A guidance circuit board 430 is also shown. In some embodiments, a guidance circuit board 430 may be located at the bottom of the guidance section and configured to interface with the seeker circuit board 360 after attachment of the two sections.

Figure 5:
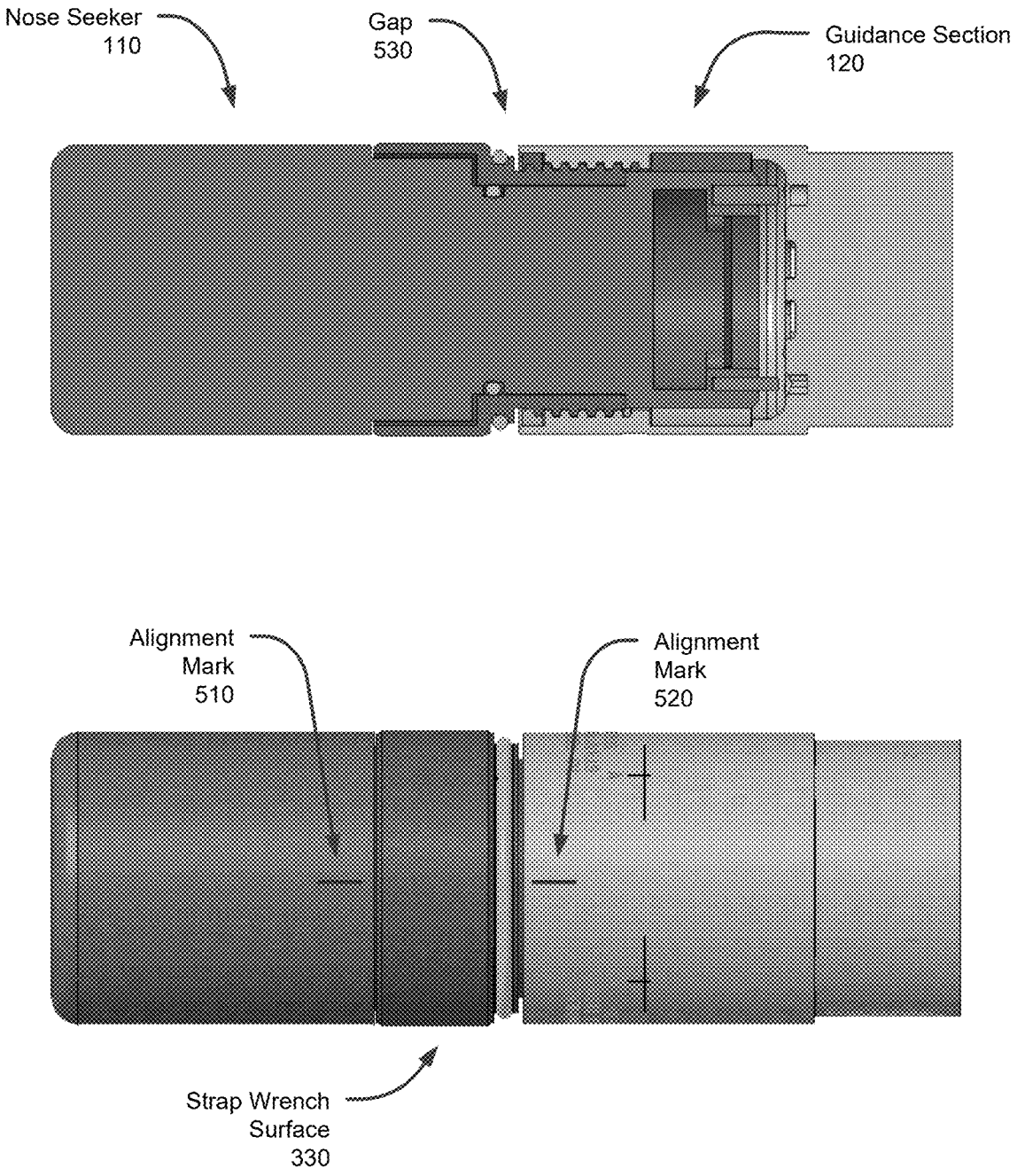
FIG. 5 illustrates mating of the nose seeker and guidance section of FIG. 2 near completion, in accordance certain embodiments of the present disclosure.

FIG. 5 illustrates mating of the nose seeker 110 and guidance section 120 of FIG. 2 near completion, in accordance certain embodiments of the present disclosure. In this view, as the mating process nears completion, a small gap 530 is visible between the nose seeker 110 and the guidance section 120. Alignment marks 510 and 520 are shown. Because the alignment pins are not visible during the mating process, the alignment marks 510 and 520 are provided to indicate the correct alignment at which the nose seeker 110 and the guidance section 120 should be held, as the threaded retainer 200 is screwed into the threaded interface 210. In some embodiments, alignment marks 510 and 520 may be engraved or painted into the surfaces of nose seeker 110 and guidance section 120 respectively to provide a visual cue of proper alignment for a technician assembling the sections.

Figure 6:
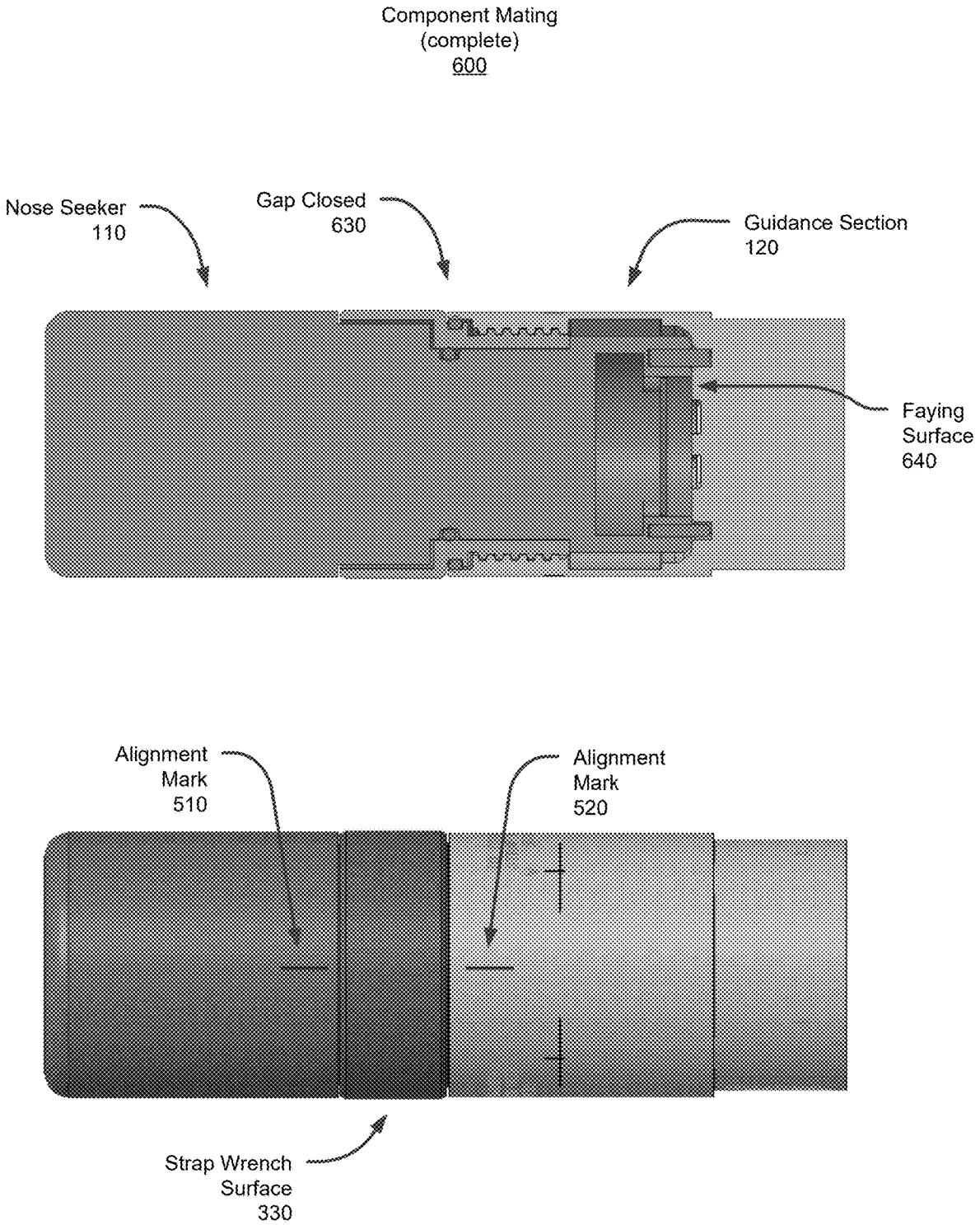
FIG. 6 illustrates mating of the nose seeker and guidance section of FIG. 2 after completion, in accordance certain embodiments of the present disclosure.

FIG. 6 illustrates mating of the nose seeker 110 and guidance section 120 of FIG. 2 after completion, in accordance certain embodiments of the present disclosure. As can be seen in this view, after completion of the mating process, the gap has been mostly closed 630 and the O-rings 300 and 310 are compressed to provide seals. When fully mated, the faying surfaces 640 of the nose seeker 110 and guidance section 120 are closed and clamped together.

For some embodiments, the assembly process may be summarized as follows. First, the nose seeker threaded retainer is threaded into the guidance section until the pins just contact the guidance section surface. Next, the nose seeker body is visually aligned to the guidance section using the alignment marks on the outside of each part. This will roughly align the pins to the hole/slot. Finally, the nose seeker and the guidance section are held at that orientation while the threaded retainer is tightened until fully seated, and the pins are engaged in the hole/slot. At this point the exterior O-ring will no longer be visible. The threaded retainer may be torqued to a specified value using the strap wrench or other suitable tool.

Although the disclosed techniques were described above with respect to a nose seeker 110 and a guidance section 120 of a missile, these techniques may be applied to the coupling of sections or components of any cylindrical platform for which rotational alignment is required. In particular, the techniques may be applied to coupling of the guidance section 120 to the payload section 130 or coupling of the payload section 130 to the rocket motor 140.

Methodology

Figure 7:
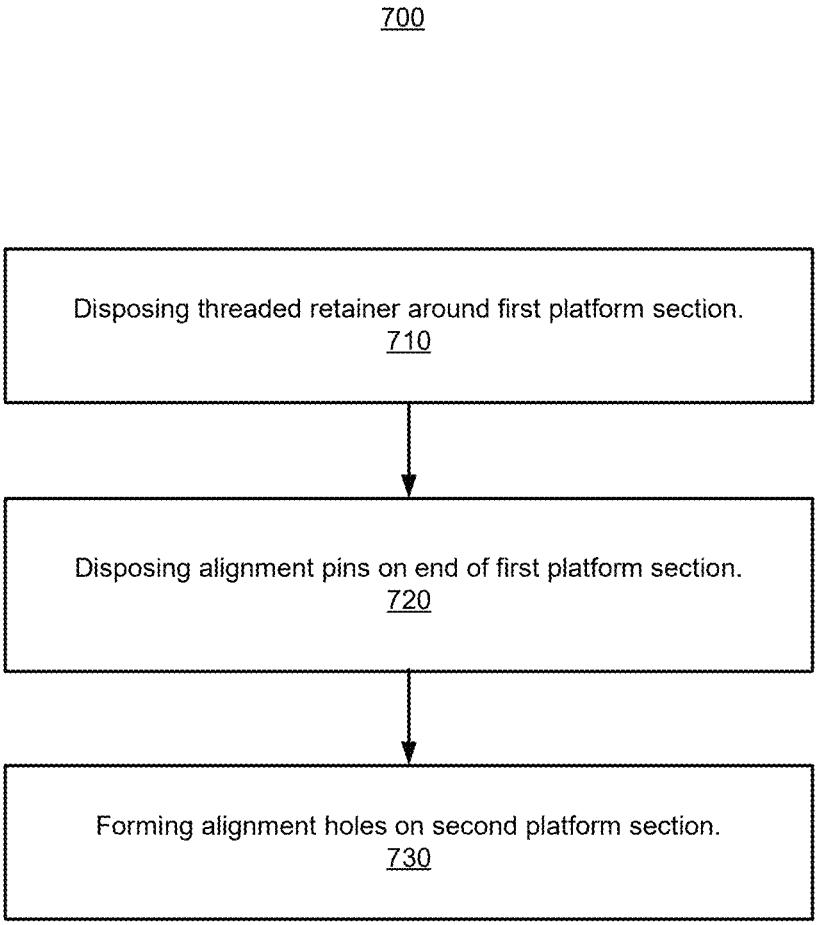
FIG. 7 is a flowchart illustrating a methodology for fabrication of a rotational alignment system, in accordance with an embodiment of the present disclosure.

FIG. 7 is a flowchart illustrating a methodology 700 for fabrication of a rotational alignment system, in accordance with an embodiment of the present disclosure. As can be seen, example method 700 includes a number of phases and sub-processes, the sequence of which may vary from one embodiment to another. However, when considered in aggregate, these phases and sub-processes form a process for fabrication of a rotational alignment system, in accordance with certain of the embodiments disclosed herein, for example as illustrated in FIGS. 1-6, as described above. However other system architectures can be used in other embodiments, as will be apparent in light of this disclosure. To this end, the correlation of the various functions shown in FIG. 7 to the specific components illustrated in the figures, is not intended to imply any structural and/or use limitations. Rather other embodiments may include, for example, varying degrees of integration wherein multiple functionalities are effectively performed by one system. Numerous variations and alternative configurations will be apparent in light of this disclosure.

In one embodiment, method 700 commences, at operation 710, by disposing a threaded retainer around an end of a first platform section to be coupled to a second platform section. The threaded retainer is configured to rotate about a longitudinal axis of the first platform section while rotationally advancing into mating threads of the second platform section.

At operation 720, alignment pins are disposed on the end of the first platform section.

At operation 730, alignment holes are formed on the second platform section. The alignment pins are configured to engage with the alignment holes to maintain alignment of the first platform section to the second platform section as the threaded retainer rotationally advances into the mating threads of the second platform section.

In some embodiments, additional operations may be performed, as previously described in connection with the system. For example, the alignment pins may be keyed to the alignment holes. In some embodiments, an engagement surface is coupled to the threaded retainer. The engagement surface is configured to provide engagement of the threaded retainer to a tool (e.g., a strap wrench) configured to facilitate rotation of the threaded retainer. In some embodiments, a first alignment mark is disposed on an outer surface of the first platform section and a second alignment mark is disposed on an outer surface of the second platform section. The first alignment mark is configured to align with the second alignment mark to provide a visual cue for alignment of the first platform section to the second platform section.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood, however, that other embodiments may be practiced without these specific details, or otherwise with a different set of details. It will be further appreciated that the specific structural and functional details disclosed herein are representative of example embodiments and are not necessarily intended to limit the scope of the present disclosure. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is an aeronautical platform comprising: a first section; a second section comprising a threaded interface; a threaded retainer disposed around an end of the first section, the end to be coupled to the second section, wherein the threaded retainer is configured to rotate about a longitudinal axis of the first section while rotationally advancing into the threaded interface of the second section; a plurality of alignment pins disposed on the end of the first section; and a plurality of alignment holes disposed on the second section, wherein each of the alignment pins is configured to engage with a corresponding one of the alignment holes to maintain alignment of the first section to the second section as the threaded retainer rotationally advances into the threaded interface.

Example 2 includes the aeronautical platform of Example 1, wherein the alignment pins are keyed to the alignment holes.

Example 3 includes the aeronautical platform of Examples 1 or 2, wherein the first section comprises an engagement surface coupled to the threaded retainer and configured to provide engagement of the threaded retainer to a tool configured to facilitate rotation of the threaded retainer.

Example 4 includes the aeronautical platform of any of Examples 1-3, comprising a first alignment mark disposed on an outer surface of the first section and a second alignment mark disposed on an outer surface of the second section, wherein the first alignment mark is configured to align with the second alignment mark to provide a visual cue for alignment of the first section to the second section.

Example 5 includes the aeronautical platform of any of Examples 1-4, wherein the aeronautical platform is a missile, the first section is a nose seeker, and the second section is a guidance section.

Example 6 includes the aeronautical platform of any of Examples 1-5, wherein the aeronautical platform is a missile, first section is guidance section, and the second section is payload module.

Example 7 includes the aeronautical platform of any of Examples 1-6, wherein the aeronautical platform is a missile, the first section is payload module, and the second section is rocket motor.

Example 8 is a first section of a platform, the first section comprising: a threaded retainer disposed around an end of the first section, the end to be coupled to a second section of the platform, wherein the threaded retainer is configured to rotate about a longitudinal axis of the first section while rotationally advancing into mating threads of the second section; and a plurality of alignment pins disposed on the end of the first section, the alignment pins configured to engage with alignment holes on the second section to maintain alignment of the first section to the second section as the threaded retainer rotationally advances into the mating threads of the second section.

Example 9 includes the first section of Example 8, wherein the alignment pins are keyed to the alignment holes.

Example 10 includes the first section of Examples 8 or 9, comprising an engagement surface coupled to the threaded retainer and configured to provide engagement of the threaded retainer to a tool configured to facilitate rotation of the threaded retainer.

Example 11 includes the first section of any of Examples 8-10, comprising a first alignment mark disposed on an outer surface of the first section and configured to align with a second alignment mark disposed on an outer surface of the second section to provide a visual cue for alignment of the first section to the second section.

Example 12 includes the first section of any of Examples 8-11, wherein the platform is a missile, the first section is a nose seeker, and the second section is a guidance section.

Example 13 includes the first section of any of Examples 8-12, wherein the platform is a missile, first section is guidance section, and the second section is payload module.

Example 14 includes the first section of any of Examples 8-13, wherein the platform is a missile, the first section is payload module, and the second section is rocket motor.

Example 15 is a method for fabricating a rotational alignment system, the method comprising: disposing a threaded retainer around an end of a first platform section to be coupled to a second platform section, the threaded retainer configured to rotate about a longitudinal axis of the first platform section while rotationally advancing into mating threads of the second platform section; disposing a plurality of alignment pins on the end of the first platform section; and forming a plurality of alignment holes on the second platform section, wherein the alignment pins are configured to engage with the alignment holes to maintain alignment of the first platform section to the second platform section as the threaded retainer rotationally advances into the mating threads of the second platform section.

Example 16 includes the method of Example 15, comprising keying the alignment pins to the alignment holes.

Example 17 includes the method of Examples 15 or 16, comprising coupling an engagement surface to the threaded retainer, the engagement surface configured to provide engagement of the threaded retainer to a tool configured to facilitate rotation of the threaded retainer.

Example 18 includes the method of any of Examples 15-17, disposing a first alignment mark on an outer surface of the first platform section and disposing a second alignment mark on an outer surface of the second platform section, wherein the first alignment mark is configured to align with the second alignment mark to provide a visual cue for alignment of the first platform section to the second platform section.

Example 19 includes the method of any of Examples 15-18, wherein the first platform section is a missile nose seeker, and the second platform section is a missile guidance section.

Example 20 includes the method of any of Examples 15-19, wherein the first platform section is a missile guidance section, and the second platform section is a missile payload module.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be appreciated in light of this disclosure. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner and may generally include any set of one or more elements as variously disclosed or otherwise demonstrated herein.

What is claimed is:

1. An aeronautical platform comprising:

a first section;

a second section comprising a threaded interface;

a threaded retainer disposed around an end of the first section, the end to be coupled to the second section, wherein the threaded retainer is configured to rotate about a longitudinal axis of the first section while rotationally advancing into the threaded interface of the second section;

a plurality of alignment pins disposed on the end of the first section; and a plurality of alignment holes disposed on the second section, wherein each of the alignment pins is configured to engage with a corresponding one of the alignment holes to maintain alignment of the first section to the second section as the threaded retainer rotationally advances into the threaded interface.

2. The aeronautical platform of claim 1, wherein the alignment pins are keyed to the alignment holes.

3. The aeronautical platform of claim 1, wherein the first section comprises an engagement surface coupled to the threaded retainer and configured to provide engagement of the threaded retainer to a tool configured to facilitate rotation of the threaded retainer.

4. The aeronautical platform of claim 1, comprising a first alignment mark disposed on an outer surface of the first section and a second alignment mark disposed on an outer surface of the second section, wherein the first alignment mark is configured to align with the second alignment mark to provide a visual cue for alignment of the first section to the second section.

5. The aeronautical platform of claim 1, wherein the aeronautical platform is a missile, the first section is a nose seeker, and the second section is a guidance section.

6. The aeronautical platform of claim 1, wherein the aeronautical platform is a missile, first section is guidance section, and the second section is payload module.

7. The aeronautical platform of claim 1, wherein the aeronautical platform is a missile, the first section is payload module, and the second section is rocket motor.

8. A first section of a platform, the first section comprising:

a threaded retainer disposed around an end of the first section, the end to be coupled to a second section of the platform, wherein the threaded retainer is configured to rotate about a longitudinal axis of the first section while rotationally advancing into mating threads of the second section; and a plurality of alignment pins disposed on the end of the first section, the alignment pins configured to engage with alignment holes on the second section to maintain alignment of the first section to the second section as the threaded retainer rotationally advances into the mating threads of the second section.

9. The first section of claim 8, wherein the alignment pins are keyed to the alignment holes.

10. The first section of claim 8, comprising an engagement surface coupled to the threaded retainer and configured to provide engagement of the threaded retainer to a tool configured to facilitate rotation of the threaded retainer.

11. The first section of claim 8, comprising a first alignment mark disposed on an outer surface of the first section and configured to align with a second alignment mark disposed on an outer surface of the second section to provide a visual cue for alignment of the first section to the second section.

12. The first section of claim 8, wherein the platform is a missile, the first section is a nose seeker, and the second section is a guidance section.

13. The first section of claim 8, wherein the platform is a missile, first section is guidance section, and the second section is payload module.

14. The first section of claim 8, wherein the platform is a missile, the first section is payload module, and the second section is rocket motor.

15. A method for fabricating a rotational alignment system, the method comprising:

disposing a threaded retainer around an end of a first platform section to be coupled to a second platform section, the threaded retainer configured to rotate about a longitudinal axis of the first platform section while rotationally advancing into mating threads of the second platform section;

disposing a plurality of alignment pins on the end of the first platform section; and forming a plurality of alignment holes on the second platform section, wherein the alignment pins are configured to engage with the alignment holes to maintain alignment of the first platform section to the second platform section as the threaded retainer rotationally advances into the mating threads of the second platform section.

16. The method of claim 15, comprising keying the alignment pins to the alignment holes.

17. The method of claim 15, comprising coupling an engagement surface to the threaded retainer, the engagement surface configured to provide engagement of the threaded retainer to a tool configured to facilitate rotation of the threaded retainer.

18. The method of claim 15, disposing a first alignment mark on an outer surface of the first platform section and disposing a second alignment mark on an outer surface of the second platform section, wherein the first alignment mark is configured to align with the second alignment mark to provide a visual cue for alignment of the first platform section to the second platform section.

19. The method of claim 15, wherein the first platform section is a missile nose seeker, and the second platform section is a missile guidance section.

20. The method of claim 15, wherein the first platform section is a missile guidance section, and the second platform section is a missile payload module.

* * * * *